US007185788B2

(12) United States Patent
Morris

(10) Patent No.: US 7,185,788 B2
(45) Date of Patent: Mar. 6, 2007

(54) COMPARTMENTED FLUID DISPENSING APPARATUS

(76) Inventor: David T. Morris, 23109 Haynes St., Farmington Hills, MI (US) 48336

( * ) Notice: Subject to any disclaimer, the term of this patent is extended or adjusted under 35 U.S.C. 154(b) by 187 days.

(21) Appl. No.: 10/953,656

(22) Filed: Sep. 29, 2004

(65) Prior Publication Data

US 2006/0086754 A1 Apr. 27, 2006

(51) Int. Cl.
*B67D 3/00* (2006.01)
*B67D 5/06* (2006.01)

(52) U.S. Cl. ..... 222/129; 222/185.1; 222/478; 222/527

(58) Field of Classification Search ..... 222/129, 222/185.1, 460, 478, 526, 427
See application file for complete search history.

(56) References Cited

U.S. PATENT DOCUMENTS 3,099,373 A * 7/1963 Gandrud ..... 222/527
3,867,117 A * 2/1975 Bebart ..... 65/374.11
4,491,246 A * 1/1985 Dooley ..... 222/129
5,890,627 A * 4/1999 Storey ..... 222/129
2004/0007591 A1* 1/2004 Sut ..... 222/129

OTHER PUBLICATIONS

Beer Bong USA, Website: www.beerbongsusa.com "Head Rush" Beer Bong Product, Las Vegas NV Dated: 1991.
Photo of Circa 1960 Beer Bong Use From Website: www.webshots.com Dated Jan. 2004.
The Bong Shop, Website: www.beerbongs.freeservers.com, Plus 8-Hose "Filopia" Beer Bong of the Bong Shop, Believed Dated 2000.

* cited by examiner

*Primary Examiner*—Joseph A. Kaufman
(74) *Attorney, Agent, or Firm*—Peter D. Keefe

(57) ABSTRACT

A compartmented fluid dispensing apparatus suitable for use as a beer "bong", which provides for simultaneous dispensing to multiple drinkers, wherein the fluid distribution is equitable and wherein fluid is distributed to only those who are actually drinking independent of the number of distribution tubes. A container has an open container mouth and a plurality of compartments, each compartment having an open compartment mouth which collectively form the open container mouth. Each compartment is fluidically isolated from each other compartment and has its own unique exit portal. Each exit portal is connected with its respective flexible distribution tube.

19 Claims, 5 Drawing Sheets

COMPARTMENTED FLUID DISPENSING APPARATUS

TECHNICAL FIELD

The present invention relates to apparatus for gravitationally dispensing drinkable fluids to one or more recipients. More particularly, the present invention relates to apparatus for gravitationally dispensing beer to one or more recipients by means of a container and one or more dispensing tubes fluidically communicating therewith.

BACKGROUND OF THE INVENTION

A practice of drinking beer out of a tube at the bottom of a funnel originated in the late 1960's when funnels and clear PVC plastics became readily available to the general public. In this regard, beer drinkers attached clear PVC distribution tube to the neck of a funnel which increased the speed with which a beer could be consumed.

A term in the relevant art which refers to an apparatus for drinking a fluid (normally beer) faster than one could consume the fluid when conventionally dispensed into the recipient's mouth from a can or bottle is known a "bong" and the act of doing so as "bonging". A "bong" is built from items usually found at automotive, hardware and home improvement stores, for example funnels (as may be, for example, used for oil) and hose clamps to secure the PVC distribution tube to the neck of the funnel.

In operation of a "bong", beer is poured into the open mouth of a funnel and exits out the narrow neck portion thereof into a flexible PVC distributing tube attached thereto. During pouring, the recipient (a "bonger" in the parlance of the relevant art) holds the funnel and the end of the distribution tube at relative elevations so that the beer cannot exit the distribution tube and flow out on to the ground. Next, the recipient places the end to the distribution tube into his/her mouth and then raises the funnel and/or adjusts the shape of the distribution tube, so that, with open throat, the beer flows freely under the urging of gravity into the stomach. Importantly for this to work as described, the mouth of the funnel must be freely open so that vacuum is not generated in the funnel as the beer "bong" process ensues. This act of "bonging" became very popular in the United States with college students and also became a hit at parties because it is a fun spectacle to watch.

Beer "bongers" have also pushed store parts to their limits by attempting to enhance the functionality of beer "bongs" to include simultaneous multiple person beer "bonging". In this regard, commercial beer "bongs" have now come onto the market featuring PVC distribution tubes connected to a manifold system that simultaneously distributes beer to multiple "bongers".

Unfortunately, all efforts to create a beer "bong" suitable for simultaneously distributing beer to multiple "bongers" have failed for a number of reasons: 1) differing beers poured into the funnel become commingled; 2) the manifold system is flawed in that the distribution tubes are commonly connected to the funnel, so that an equal amount of beer cannot be equally distributed to each "bonger" even if "bongers" are careful in how they tilt the funnel to distribute beer to each distribution tube; and 3) the number of distribution tubes requires a similar number of users, which number cannot be changed lest some beer will be undesirably delivered into unused distribution tubes from the funnel if not enough "bongers" are present to drink from all the distribution tubes.

Accordingly, what remains needed in the art is a liquid dispensing apparatus (a beer "bong") which provides for simultaneous dispensing to multiple drinkers, wherein the fluid distribution is equitable as among the drinkers, and accommodates only those who are actually drinking independent of the number of distribution tubes.

SUMMARY OF THE INVENTION

The present invention is a compartmented fluid dispensing apparatus, suitable for use as a beer "bong", which provides for simultaneous dispensing to multiple drinkers, wherein the fluid distribution is equitable and wherein the fluid is distributed to only those who are actually drinking, independently of the number of distribution tubes.

The compartmented fluid dispensing apparatus according to the present invention is composed of a container having an open container mouth and a plurality of compartments, each compartment having an open compartment mouth which collectively form the open container mouth of the container. Each compartment is fluidically isolated from each other compartment and has its own exclusive exit portal. Each exit portal is connected with its own respective flexible distribution tube.

In a preferred form of the compartmented fluid dispensing apparatus, the container has a frustoconically shaped side wall, and each of the compartments comprise a wedge shape which partly shares a portion of the container side wall and partly shares a pair of divider walls. Each of the compartments occupies an equal volume. The number of compartments may be any number, odd or even, wherein eight compartments is most preferred.

In operation, at least one type of fluid is poured into one or more compartments via its respective open compartment mouth, (any compartment receiving fluid is designated as an "active compartment", while any compartment not receiving fluid is designated as an "inactive compartment"). The pouring of the at least one type of fluid may involve different fluids being delivered into any of the active compartments. In so doing, the user or users hold his/her respective distribution tube from his/her active compartment so that it has a downwardly directed U-shape which collects the fluid poured into his/her active compartment and the fluid is unable to escape the end of the distribution tube. Once all the active compartments have been delivered their respective fluid, the users deliver their respective fluid into their mouth by straightening the U-shape of the distribution tubing, usually accompanied by raising upwardly the container. It is considered most preferable for fun purposes, but it is not necessary, for each user to deliver the fluid into his/her mouth simultaneously and as quickly as possible in competitive racing fun among the drinkers.

From the foregoing, it is readily seen that the fluid delivered to any one compartment is completely exclusive of any other compartment, all the way to the end of its respective distribution tube. Of particular note is that the compartmented fluid distribution apparatus according to the present invention provides a "bong" apparatus for "bonging" beer without any of the aforementioned detriments that have plagued the prior art.

Accordingly, it is an object of the present invention to provide a compartmented fluid distribution apparatus according to the present invention which is particularly suitable for "bonging" beer without fluid loss among a greater or lesser number of simultaneous participants, with equitable fluid distribution, and without fluid commingling.

This and additional objects, features and advantages of the present invention will become clearer from the following specification of a preferred embodiment.

DESCRIPTION OF THE PREFERRED EMBODIMENT

Figure 1:
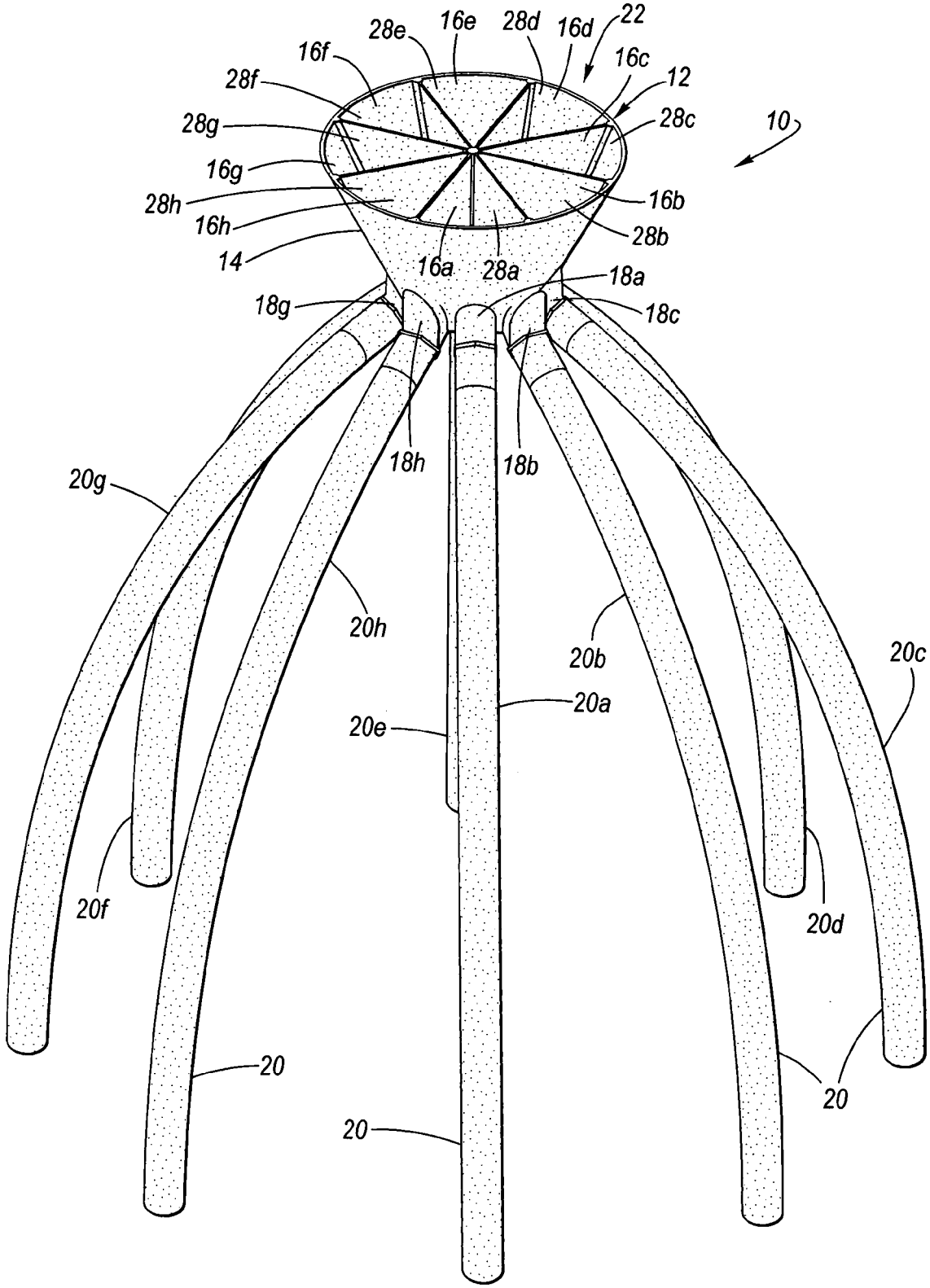
FIG. 1 is a top perspective view of a compartmented fluid distribution apparatus according to the present invention.

Referring now to the Drawing, FIGS. 1 through 7 depict various aspects of a preferred embodiment of a compartmented fluid distribution apparatus 10 according to the present invention. As can be seen from reference to FIGS. 1 and 2, the compartmented fluid distribution apparatus 10 includes a container 12 defined by a sidewall 14, a plurality of compartments 16 subdividing the interior space of the container, a plurality of exit portals 18, one exit portal, respectively, for each compartment, and a plurality of flexible distribution tubes 20, one distribution tube, respectively, for each exit portal.

Figure 6:
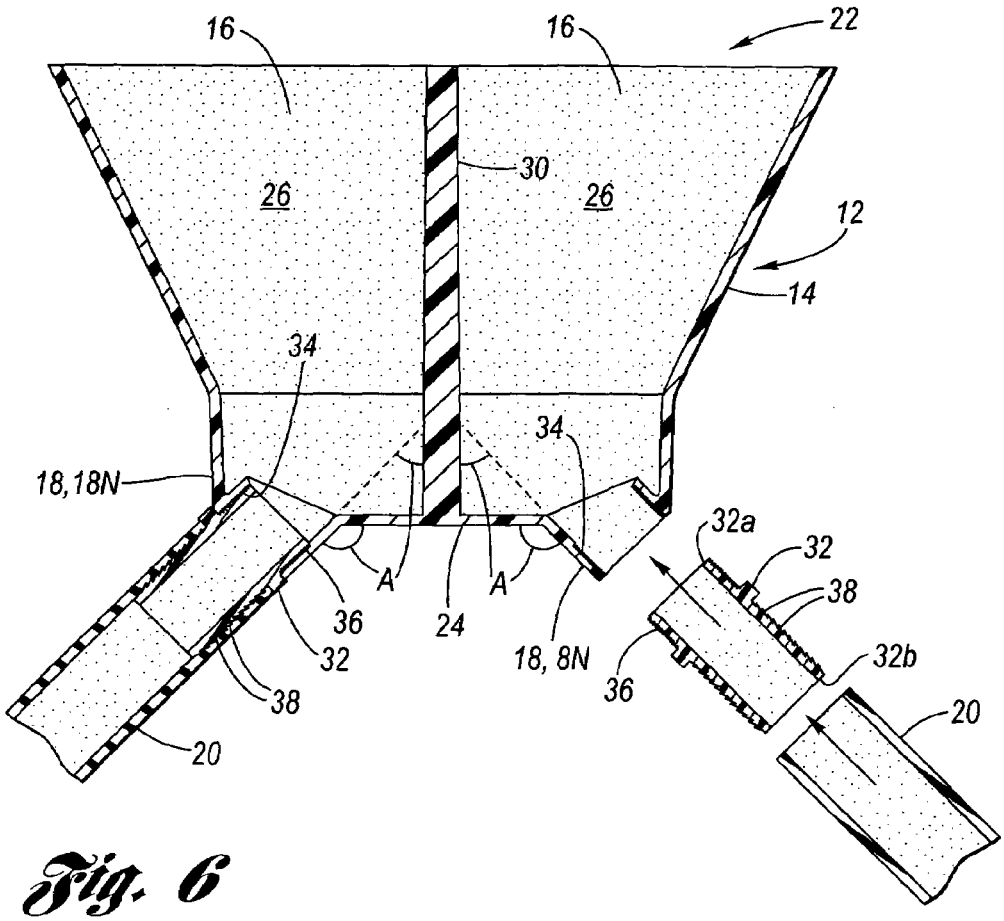
FIG. 6 is a sectional view of the compartmented fluid distribution apparatus, seen along line 6—6 of FIG. 5.

The sidewall 14 of the container 12 is preferably frustoconical in shape, being characterized by an open container mouth 22 at its greatest girth, tapering to a least girth at a floor portion 24 of the sidewall (see FIG. 6). Other sidewall shapes are possible, as for example a cylindrical shape. Each of the exit portals 18 emanates from the sidewall 14 adjoining the floor portion 24 in exclusive fluidic communication with its respective compartment 16. Divider walls 26 demarcate the compartments 16 by radially extending from a centrally disposed spine 30 to the sidewall 14, and extending, parallel to the spine, from the open container mouth 22 to the floor portion 24. Each divider wall 26 is sealingly affixed so that each compartment 16 defined thereby is fluidically isolated from every other compartment.

Each compartment 16 is preferably pie-shaped, having preferably an equal volume and has a compartment open mouth 28 which forms a constituent of the open container mouth 22 (wherein all the compartment open mouths collectively form the open compartment mouth). Accordingly, any fluid poured into a compartment 16 is exclusively retained in that compartment and is only exitable therefrom at its respective exit portal 18 and into its respectively attached distribution tube 20.

Figure 2:
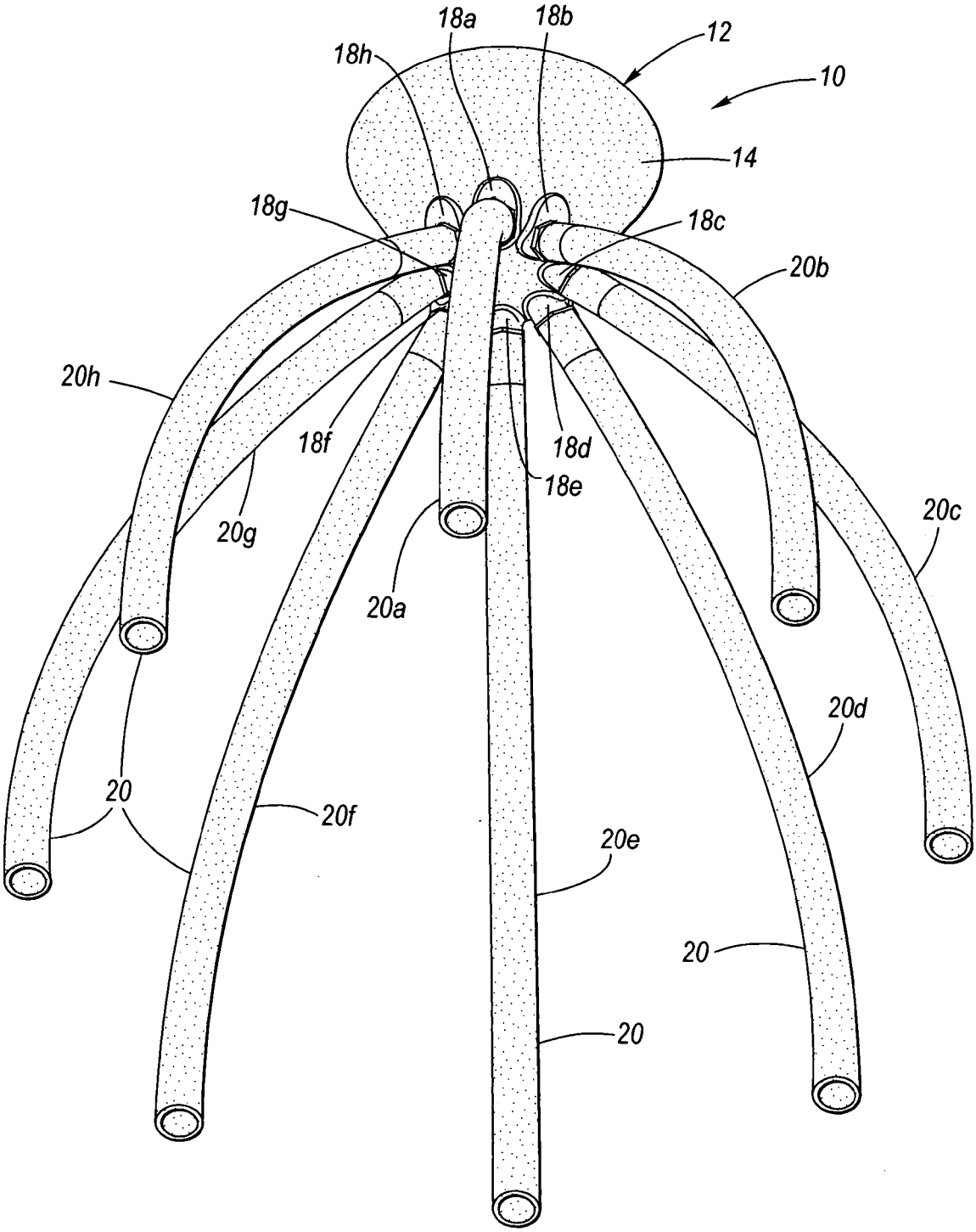
FIG. 2 is a bottom perspective view of a compartmented fluid distribution apparatus as shown at FIG. 1.
Figure 3:
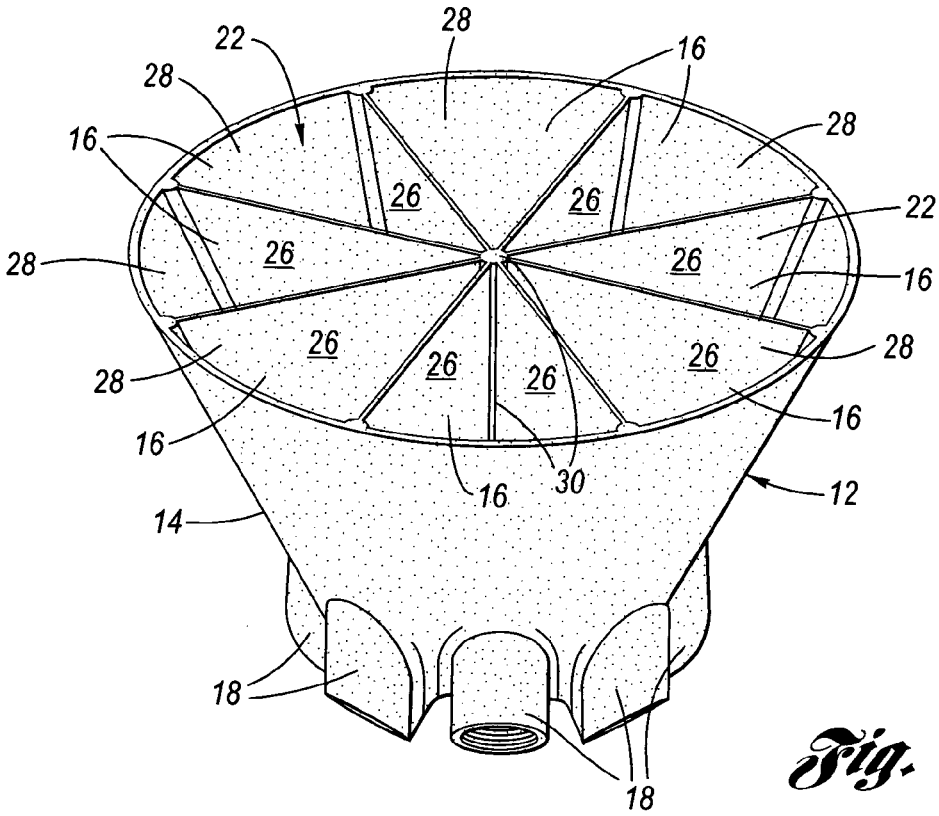
FIG. 3 is a top perspective view of a container of the compartmented fluid distribution apparatus as shown at FIG. 1.
Figure 4:
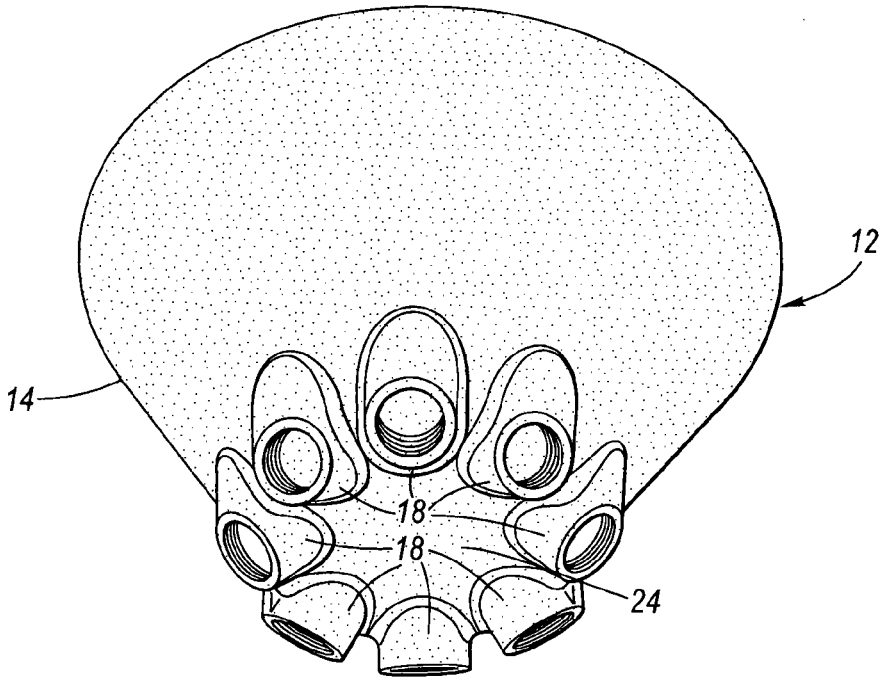
FIG. 4 is a bottom perspective view of the container of the compartmented fluid distribution apparatus as shown at FIG. 1.
Figure 5:
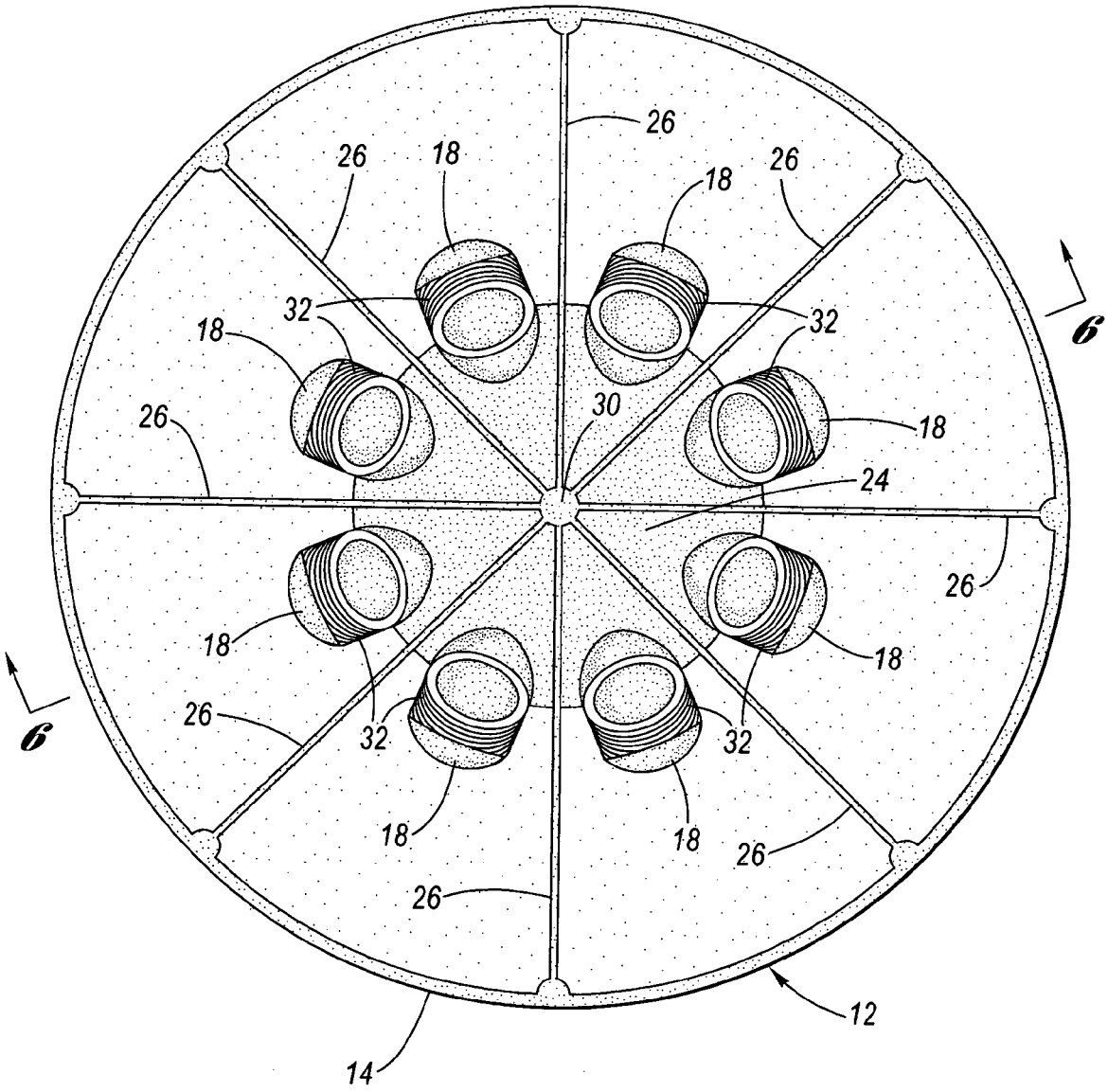
FIG. 5 is a top plan view of the container of the compartmented fluid distribution apparatus as shown at FIG. 1.

Referring to FIGS. 1 and 2, it will be seen that the number of compartments 16 (and consequently the number of divider walls 26) is preferentially eight in number, and that the structural interrelationship is, therefore, as follows: Compartment 16*a* exclusively includes compartment open mouth 28*a*, exit portal 18*a* and distribution tube 20*a*; compartment 16*b* exclusively includes compartment open mouth 28*b*, exit portal 18*b* and distribution tube 20*b*; compartment 16*c* exclusively includes compartment open mouth 28*c*, exit portal 18*c* and distribution tube 20*c*; compartment 16*d* exclusively includes compartment open mouth 28*d*, exit portal 18*d* and distribution tube 20*d*; compartment 16*e* exclusively includes compartment open mouth 28*e*, exit portal 18*e* and distribution tube 20*e*; compartment 16*f* exclusively includes compartment open mouth 28*f*, exit portal 18*f* and distribution tube 20*f*; compartment 16*g* exclusively includes compartment open mouth 28*g*, exit portal 18*g* and distribution tube 20*g*; and compartment 16*h* exclusively includes compartment open mouth 28*h*, exit portal 18*h* and distribution tube 20*h*.

Each exit portal 18 preferably is in the form of a nipple 18N that is integrally formed with the sidewall 14 adjoining the floor portion 24 thereof (see FIG. 6). Each exit portal 18 (that is, nipple 18N) projects at a relative angle A of about 45 degrees with respect to the floor portion 24 and the spine 30 (shown at FIG. 6).

In order to connect a distribution tube 20 to the exit portal 18 (that is, the nipple 18N), it is preferred to utilize an intermediary tubular adapter coupling 32. By way of preferential construction which allows for removal of parts for cleaning and service, FIG. 6 shows that each nipple 18N has interior threading 34 which is threadably engaged with exterior threading 36 at an inboard end 32*a* of the adapter coupling 32. The opposite, outboard end 32*b* of the adapter coupling 32 is provided with annular barbs. In this regard, one end of the distribution tube 20 is expansively forced (allowed for by the inherent resiliency of the distribution tube) over the annular barbs 38 so as to be sealingly seated on the outboard end of the coupling adapter.

By way of preferred exemplification only (and not limitation), structural and dimensional aspects of the compartmented fluid distribution apparatus 10 will now be detailed.

The container 12 is preferably formed of an FDA food grade plastic, most preferably a polypropylene, having a volume of about ninety-six fluid ounces, wherein each of the eight compartments, therefore, has a volume of about twelve fluid ounces. Each coupling adapter 32 is preferably constructed of FDA food grade nylon about two inches in length, having an inside diameter of about one inch (for example, a commercially available 1 inch I.D. ¾ inch NPT/MIP nylon adapter). Each distribution tube 20 is preferably formed of FDA certified food grade, flexible, clear PVC plastic, having a length of about thirty inches, with an inside diameter of about one inch and an outside diameter of about one and one-quarter inches, wherein each distribution tube has a volume of about thirty fluid ounces.

Accordingly, each compartment and its distribution tube have a volume of about forty-two fluid ounces, and a total volume of the compartmented fluid distribution apparatus 10 is about three hundred thirty-six fluid ounces, wherein the percentage of volume of the distribution tubes is about seventy-one percent of the total volume. By way of exemplification in terms of volumetrics, a single user may pour twelve fluid ounces of a drinkable fluid into his/her predetermined compartment, and all the fluid will be directed to its respective distribution tube; if for example more than about thirty fluid ounces are to be to consumed, then all the volume of the distribution tube will be filled, and some of the fluid will remain in the compartment until consumption commences.

The above structural recitations are by way merely of preferred exemplification, and other structural aspects may be advantageously adopted. For non-limiting example, the volume of the compartments may be varied, the length and/or diameter of the distribution tubes may be varied, the number of compartments may be varied, and the size of the coupling adapters may be varied (as for example to enhance fluid flow therethrough).

Preferred manufacturing steps of the compartmented fluid dispensing apparatus 10 according to the present invention will now be detailed.

The container 12, inclusive of the divider walls 26 and the exit portals 18 (ie., the nipples 18N) are formed integrally via a plastic injection molding process well known in the art. For example, a multiple component mold is used. In a first molding process, the sidewall 14 and the exit portals 18 are formed, then an insert of the mold is used to subsequently mold the eight divider walls 26 and the center spine 28, all then being sealingly fused together.

Figure 7:
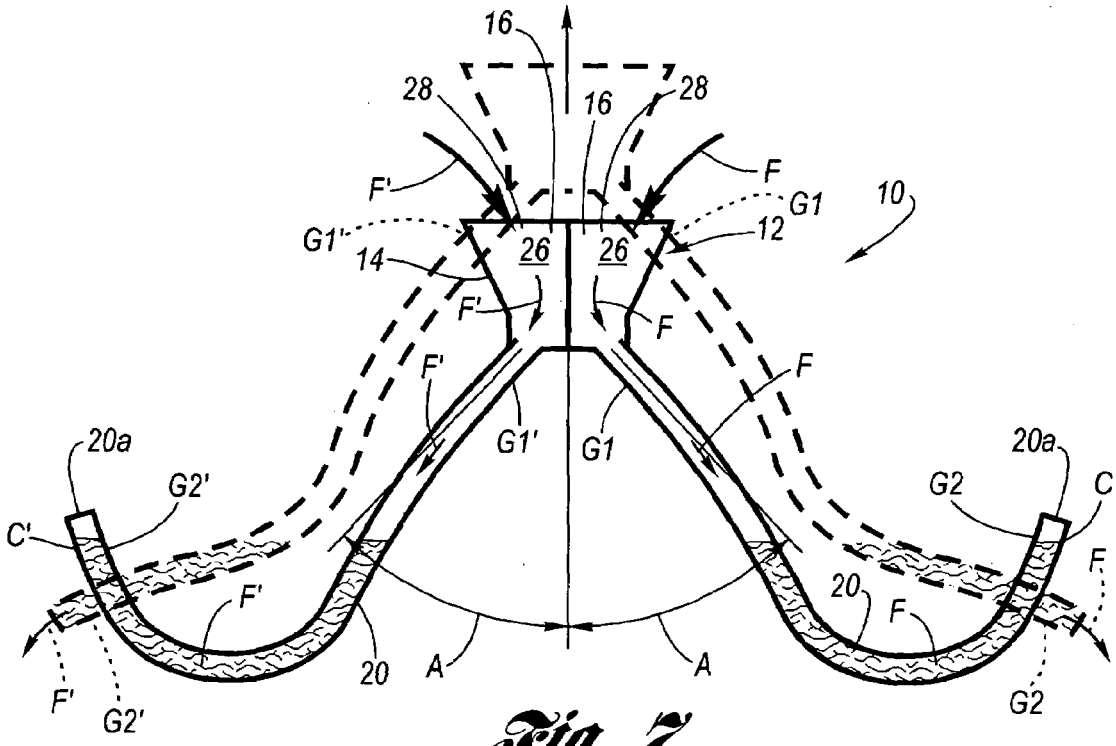
FIG. 7 is a schematic view of the compartmented fluid distribution apparatus similar to FIG. 6, now showing a stage of operation in solid lines and a later stage of operation in dashed lines.

Referring now to FIG. 7, an example of operation of the compartmented fluid dispensing apparatus 10 will be detailed. In this regard, merely be way of simplified example, operation with respect to two simultaneous users will be described.

At least one type of fluid F, F' is poured into each of the active compartments 16, (any compartment receiving fluid is designated as an "active compartment", while any compartment not receiving fluid is designated as an "inactive compartment"). The pouring of the at least one type of fluid may involve different fluids being delivered into any of the active compartments.

In so doing, as can be understood from the solid line view of FIG. 7, the users hold his/her respective distribution tube 20 from his/her active compartment, at, for example, first hand grasp locations G1 and G1' and the end portion of the respective distribution tube pressed against his/her chest C, C', so that the respective distribution tube has a downwardly bowed U-shape which collects the fluid poured into his/her active compartment and the fluid is unable to escape the end 20*a* of the respective distribution tube.

Once all the active compartments have been delivered their respective fluid, the users deliver their respective fluid into their mouth by using second hand grasp locations G2, G2', as can be understood from the dashed line view of FIG. 7, and then straighten the U-shape of the respective distribution tubes while simultaneously raising upwardly the container using the first hand grasp locations G1, G1' so as to cause the fluid to gravitationally flow into his/her mouth. In this regard, it will be noted that the exit portal angle A of forty-five degrees helps to keep the relative altitude and attitude of the container 12 and the ends 20*e* of the distribution tubes optimal. It will be additionally noted that the act of straightening the distribution tubes involves raising of the container if the ends 20*a* are held at constant elevation, the group of simultaneous users carrying out this act in unison being most preferred.

It is considered most preferable for fun purposes, but it is not necessary, for each user to deliver the fluid into his/her mouth simultaneously and as quickly as possible, to provide an element of competition excitement as to who can drink the fastest.

Any combination of users (up to eight per the embodiment depicted herein) can use the compartmented fluid dispensing apparatus 10. For example, if there are three users who wish to race each other in consuming fluids, they can simply pour fluid into any three of the (now active) compartments and no loss of fluid will transpire as no leakage to the other (no inactive) compartments can occur.

From the foregoing, it is readily seen that the fluid delivered to any one compartment is completely exclusive of any other compartment, all the way to the end 20*a* of its respective distribution tube 20. Of particular note is that the compartmented fluid distribution apparatus according to the present invention provides a "bong" apparatus for "bonging" beer without any of the aforementioned detriments that have plagued the prior art.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. A compartmented fluid dispensing apparatus, comprising:

a container comprising a sidewall defining an open container mouth;

a plurality of compartments within said container;

a plurality of exit portals formed in said sidewall distally disposed with respect to said open container mouth, one said exit portal respectively for each said compartment so as to fluidically communicate therewith exclusive of any other said compartment;

a plurality of flexible distribution tubes, one distribution tube respectively connected to each said exit portal; and a plurality of divider walls connected in sealing relation with said sidewall, said plurality of divider walls extending to substantially said open container mouth such that each compartment has an open compartment mouth which is a constituent of said open container mouth, wherein said plurality of divider walls define said plurality of compartments such that each said compartment is fluidically isolated with respect to each other said compartment.

2. The apparatus of claim 1, wherein each compartment of said plurality of compartments has a substantially equal volume.

3. The apparatus of claim 2, wherein said sidewall further comprises a floor portion oppositely disposed in relation to said container open mouth, wherein each said exit portal emanates from said sidewall adjoining said floor portion thereof.

4. The apparatus of claim 3, wherein each exit portal emanates from said sidewall at an angle of substantially forty-five degrees with respect to said floor portion.

5. The apparatus of claim 2, wherein said plurality of compartments comprises eight said compartments.

6. The apparatus of claim 2, further comprising a spine centrally disposed within said container, wherein said divider walls radially extend in sealing relation between said spine and said sidewall.

7. The apparatus of claim 6, wherein each said exit portal emanates from said sidewall at an angle of substantially forty-five degrees with respect to said spine.

8. The apparatus of claim 7, wherein each said exit portal comprises a nipple; further comprising a plurality of selectively removable adapter couplings, each adapter coupling being sealingly connected to a respective said nipple and sealingly connected to a respective said distribution tube.

9. The apparatus of claim 8, wherein said sidewall further comprises a floor portion oppositely disposed in relation to said container open mouth, wherein each said exit portal emanates from said sidewall adjacent said floor portion.

10. The apparatus of claim 9, wherein each exit portal emanates from said sidewall at an angle of substantially forty-five degrees with respect to said floor portion.

11. The apparatus of claim 10, wherein said plurality of compartments comprises eight said compartments.

12. The apparatus of claim 11, wherein said sidewall further comprises a substantially frustoconical shape.

13. The apparatus of claim 7, wherein said sidewall further comprises a floor portion oppositely disposed in relation to said container open mouth, wherein each said exit portal emanates from said sidewall adjacent said floor portion.

14. The apparatus of claim 13, wherein each exit portal emanates from said sidewall at an angle of substantially forty-five degrees with respect to said floor portion.

15. The apparatus of claim 14, wherein each said exit portal comprises a nipple; further comprising a plurality of selectively removable adapter couplings, each adapter coupling being sealingly connected to a respective said nipple and sealingly connected to a respective said distribution tube.

16. The apparatus of claim 15, wherein said plurality of compartments comprises eight said compartments.

17. A compartmented fluid dispensing apparatus, comprising:

a container comprising a sidewall defining an open container mouth;

a plurality of compartments within said container;

a plurality of exit portals formed in said sidewall distally disposed with respect to said open container mouth, one said exit portal respectively for each said compartment so as to fluidically communicate therewith exclusive of any other said compartment;

a plurality of divider walls connected in sealing relation with said sidewall, said plurality of divider walls extending to substantially said open container mouth such that each compartment has an open compartment mouth which is a constituent of said open container mouth, wherein said plurality of divider walls define said plurality of compartments such that each said compartment is fluidically isolated with respect to each other said compartment; and a plurality of flexible distribution tubes, one distribution tube respectively connected to each exit portal;

wherein said plurality of compartments comprises eight said compartments.

18. The apparatus of claim 17, further comprising:

a spine centrally disposed within said container, wherein said divider walls radially extend in sealing relation between said spine and said sidewall;

wherein each exit portal emanates from said sidewall at an angle of substantially forty-five degrees with respect to said spine.

19. A compartmented fluid dispensing apparatus, comprising:

a container comprising a sidewall defining an open container mouth;

a plurality of compartments within said container;

a plurality of exit portals formed in said sidewall distally disposed with respect to said open container mouth, one said exit portal respectively for each said compartment so as to fluidically communicate therewith exclusive of any other said compartment;

a plurality of divider walls connected in sealing relation with said sidewall, said plurality of divider walls extending to substantially said open container mouth such that each compartment has an open compartment mouth which is a constituent of said open container mouth, wherein said plurality of divider walls define said plurality of compartments such that each said compartment is fluidically isolated with respect to each other said compartment, and such that each said compartment has an equal volume;

a spine centrally disposed within said container, wherein said divider walls radially extend in sealing relation between said spine and said sidewall; and a plurality of flexible distribution tubes, one distribution tube respectively connected to each exit portal;

wherein each exit portal emanates from said sidewall at an angle of substantially forty-five degrees with respect to said spine; and wherein said plurality of compartments comprises eight said compartments.

* * * * *